US005763369A

United States Patent [19]

Baumgart et al.

[11] Patent Number: 5,763,369

[45] **Date of Patent: *Jun. 9, 1998**

[54] MOTOR OIL PERFORMANCE-ENHANCING FORMULATION

[75] Inventors: Richard J. Baumgart, Ashland, Ky.; Michael A. Dituro, Huntington, W. Va.

[73] Assignee: Ashland, Inc., Lexington, Ky.

[ * ] Notice: The term of this patent shall not extend beyond the expiration date of Pat. No. 5,641,731.

[21] Appl. No.: 334,513

[22] Filed: Nov. 4, 1994

[51] Int. Cl.[6] ..... C10M 147/02

[52] U.S. Cl. ..... 508/183; 508/181

[58] Field of Search ..... 252/58; 508/181, 508/183

[56] References Cited

U.S. PATENT DOCUMENTS

| | | | |
|---|---|---|---|
| 3,445,393 | 5/1969 | Hinds | 508/181 |
| 3,869,393 | 3/1975 | Booker | 508/181 |
| 4,284,518 | 8/1981 | Reick | 252/58 |
| 4,284,519 | 8/1981 | Reick | 252/58 |
| 4,333,840 | 6/1982 | Reick | 252/58 |
| 4,349,444 | 9/1982 | Reick | 252/58 |
| 4,421,658 | 12/1983 | Reick | 508/183 |
| 4,525,286 | 6/1985 | Reick | 252/58 |
| 4,608,282 | 8/1986 | Runge | 252/58 |
| 4,615,917 | 10/1986 | Runge | 252/58 |
| 4,859,352 | 8/1989 | Waynick | 252/41 |
| 5,160,646 | 11/1992 | Scheld | 252/58 |
| 5,344,579 | 9/1994 | Ohtani et al. | 252/51.5 |

OTHER PUBLICATIONS

Molyvan A, B, C, 855, 822, 856–B, 856–R.T. Vanderbilt Company, Inc., 30 Winfield Street, Norwalk, CT 06856 Technical Brochures.

Vanlube R.T. Vanderbilt Company, Inc., 30 Winfield St., Norwalk, CT 06856 Technical Brochures.

Emery 2936, 3004, 3006, 2960, 2935, 2929, 2931 Synthetic Lubricant from Heukel Corporation, Emery Group, 11501 Northlake Dr., Cincinnati, OH 45240.

Emery 2939, 2940 Synthetic Lubricant Basestock from Heukel Corporation, Emery Group, 11501 Northlake Dr., Cincinnati, OH 45240.

HATCO 2352, 2962, 2925, 2938, 2939, 2970 Hatco, 1020 King George Post Rd. Fords, N.J. 08863.

HATCO 3178 Hatco, 1020 King George Post Rd., Fords, N.J. 08863.

Mobil SHF–402, SHF–41, SHF–62, P–43 Technical Bulletins from Mobil Chemical Company, Chemical Products Division, Box 3140, Edison, N.J. 08813.

LUBRIZOL 8955 Technical Bulletin from The Lubrical Corp., 29400 Lakeland Blvd., Wickliffe, OH 44092.

DURASYN 164, 166, 168, 174, 162 Albemarle Technical Bulletin from Albemarle, 451 Florida Street, Baton Rouge, LA 70801.

(List continued on next page.)

*Primary Examiner*—Ellen M. McAvoy

*Attorney, Agent, or Firm*—Middleton & Reutlinger; David W. Carrithers

[57] ABSTRACT

According to the invention, combining some or all of the following components: oil soluble Molybdenum additive (Molyvan 855—Vanderbilt Chemical); ("Synthetic") polyalphaolefin (PAO) 4 cSt; PAO 6 cSt and/or synthetic diester (e.g., Chemaloy M-22A); PTFE (polytetrafluoroethylene colloidal dispersed product—Acheson Chemical) Dispersant Inhibitor (DI) package containing zinc dithiophosphate (ZDP), etc., (Chemaloy D-036); Mineral Oil Base Stock; Viscosity Index Improver (VI) (Shellvis 90-SBR); into a package for addition to conventional motor oil results in improved wear, oxidation resistance, viscosity stability, engine cleanliness, fuel economy, cold starting, and inhibited acid formation. It has been discovered that when added to the crankcase of an internal combustion, e.g., spark ignition (SI) engine at most preferably approximately 20–25 vol. % with the conventional crankcase lubricant, this provides synergistic performance improvement of the oil and engine. The formulation is compatible with engine warranty requirements, i.e.,service classification API SH.

72 Claims, 5 Drawing Sheets

OTHER PUBLICATIONS

HiTEC 1111 A, 1131 A Technical Bulletin from Ethyl Petroleum Additives, Inc., 530 South Fourth Street, Richmond, VA 23219, 1995.

SHELLVIS 90 Technical Bulletin from Shell Chemical Company.

SLA 1612 Technical Bulletin from Achessen Colloids Company, Port Huron, MI 48060.

100, 325 Hydro Finished Neutral–Technical Bulletin from Ashland Inc Box 391, Ashland KY 41114.

Smalheer et al, "Lubricant Additives", Chapter I, Chemistry of Additives, pp. 1–11, 1967.

MOTOR OIL PERFORMANCE-ENHANCING FORMULATION

BACKGROUND OF THE INVENTION

I. Field of the Invention

The above invention relates to the general field of additives for lubricating oils generally classified in U.S. Class 252, Subclass 47.5, Class 44, Subclass 376; Class 44, Subclass 348; Class 44, Subclass 386; Class 252, Subclass 48.2; Class 252, Subclass 49.3; Class 252, Subclass 78.1.

II. Description of the Prior Art

U.S. Pat. No. 4,879,045 to Eggerichs adds lithium soap to a synthetic base oil comprising diester oil and polyalphaolefins which can comprise an aliphatic diester of a carboxylic acid such as di-2-ethylhexylazelate, di-isodecyladipate, or ditridecyladipate. *Encyclopedia of Chemical Technology*, 34th addition, volume 14, pp 477–526 describes lubricant additives including detergent-dispersant, viscosity index (VI) improvers, foam inhibitors, and the like.

Numerous articles have recently discussed the addition of polytetrafluoroethylene (PTFE) to lubricating oils.

A search in an electronic database of U.S. Patents since about 1972 discloses no patents mentioning PTFE (or polytetrafluoroethylene) molybdenum (Mo) and diester in the same paragraph.

U.S. Pat. No. 4,333,840 to Reick teaches hybrid PFTE lubricant and describes an optional addition of a molybdenum compound in a carrier oil. It uses a carrier oil that has a viscosity that is "unacceptable in weapons applications" which is diluted by a synthetic lubricant of low viscosity. While these formulations are suggested for lubricating skis, there is no suggestion that they are applicable to lubrication of rotating equipment.

U.S. Pat. No. 4,615,917 and U.S. Pat. No. 4,608,282 to Runge teach blending sintered fluoropolymer (e.g., PTFE) with solvents which evaporate to leave a thin film when the formulation is sprayed or applied as a grease to a metal surface, e.g., boat hulls, aircraft, dissimilar metals.

SUMMARY OF THE INVENTION

I. General Statement of the Invention

According to the invention, combining some or all of the following components: oil soluble molybdenum additive (Molyvan 855—Vanderbilt Chemical); ("Synthetic") polyalphaolefin (PAO) 4 cSt; PAO 6 cSt and/or synthetic diester (e.g., Chemaloy M-22A); PTFE (polytetrafluoroethylene colloidal dispersed product—Acheson Chemical) Dispersant Inhibitor (DI) package containing zinc dithiophosphate (ZDP), etc., (Chemaloy D-036); Mineral Oil Base Stock; Viscosity Index Improver (VI) e.g.,(Shellvis 90-SBR); into a package for addition to conventional motor oil results in surprising improvement in engine wear, oxidation resistance, viscosity stability, engine cleanliness, fuel economy, cold starting, and inhibits acid formation.

It has been discovered that, when added to the crankcase of an internal combustion, e.g., spark ignition (SI) engine at most preferably approximately 20–25 vol. % with the conventional crankcase lubricant, such compositions provide synergistic performance improvement of both the oil and the engine. The formulation is compatible with engine warranty lubrication requirements, i.e., service classification API SH.

Each of the preferred ingredients of the composition, whether mandatory or optional, is discussed below:

Molybdenum Additive

The most preferred molybdenum additive is an oil-soluble organo molybdenum compound, such as Molyvan 855. In general, the organo molybdenum compounds are preferred because of their superior solubility and effectiveness. Exemplary of these is Molyvan L, a di-thiophosphomolybdate made by R. T. Vanderbilt Company, Inc., New York, N.Y. USA. Molyvan L is sulfonated oxymolybdenum dialkyldithiophosphate. Molyvan L contains about 80 wt. % of the sulfide molybdenum di-thiophosphate of the formula given in U.S. Pat. No. 5,055,174 to Howell.

Molyvan A is also made by Vanderbilt and contains about 28.8 wt. % MO, 31.6 wt. % C, 5.4 wt. % H, and 25.9 wt. % S. Also useful are Molyvan 871, 855, 856, 822, and 807 in decreasing order of preference.

Also useful is Sakura Lube-500, which is more soluble Mo dithiocarbate containing lubricant additive obtained from Asahi Denka Corporation and comprised of about 20.2 wt. % MO, 43.8 wt. % C, 7.4 wt. % H, and 22.4 wt. % S.

Also useful is Molyvan 807, a mixture of about 50 wt. % molybdenum ditridecyldithyocarbonate, and about 50 wt. % of an aromatic oil having a specific gravity of about 38.4 SUS and containing about 4.6 wt. % molybdenum, also manufactured by R. T. Vanderbilt.

Other sources are molybdenum Mo(Co)6, marketed by Aldrich Chemical Company, Milwaukee, Wis. and molybdenum naphthenethioctoate marketed by Shephard Chemical Company, Cincinnati, Ohio.

Inorganic molybdenum compounds such as molybdenum sulfide and molybdenum oxide are substantially less preferred than the organic compounds as described. Most preferred are organic thio and phospho compounds such as those typified by the Vanderbilt and other molybdenum compounds described specifically above.

The preferred dosage in the total lubricant is from about 0.05 to about 5, more preferably from about 0.07 to about 3, and most preferably of from about 0.1–2% by weight Mo.

Synthetics

Diesters

The most preferred are di-aliphatic diesters of alkylcarboxylic acids such as di-2-ethylhexylazelate, di-isodecyladipate, and di-tridecyladipate, commercially available under the brand name Emery 2960 by Emery Chemicals, described in U.S. Pat. No. 4,859,352 to Waynick. Other suitable diesters are manufactured by Mobil Oil.

Particularly preferred synthetic-based stocks are mixtures of diesters with polyalphaolefins, described below. Also useful are polyol esters such as Emery 2935, 2936, and 2939 from the Emery group of Henkel Corporation and Hatco 2352, 2962, 2925, 2938, 2939, 2970, 3178, and 4322 polyol esters from Hatco Corporation, described in U.S. Pat. No. 5,344,579 to Ohtani et al. and Mobil ester P 24 from Mobil Chemical Company. Mobil esters such as made by reacting dicarboxylic acids, glycols, and either monobasic acids or monohydric alcohols like Emery 2936 synthetic-lubricant base stocks from Quantum Chemical Corporation and Mobil P 24 from Mobil Chemical Company can be used.

Generally speaking, the most preferred diesters include the adipates, azelates, and sebacates of C4–C13 alkanols or mixtures thereof; n-phthalates of C4–C13 alkynoles or mixtures thereof. Mixtures of diesters can also be used.

Polyalphaolefin (PAO)

Useful PAOs include the Ethyl-flow series by Ethyl Corporation, including Ethyl-flow 162, 164, 166, 168, and 174, having varying viscosities from about 2 to about 460 centistoke. Mobil SHF-42 from Mobil Chemical Company; Emery 3004 and 3006 PAO base stocks from polyalphaolefins from Quantum Chemical Company.

Additional satisfactory polyalphaolefins are those sold by Uniroyal Inc. under the brand Synton PAO-40, which is a 40 centistoke polyalphaolefin.

Also useful are the Oronite brand polyalphaolefins manufactured by Chevron Chemical Company.

Preferred polyalphaolefins will have a viscosity in the range of about 2–10 centistoke at 200° C. with viscosities of 4 and 6 centistoke being particularly preferred.

Mobil ester P-43 and Hatco Corp. 2939 are particularly preferred.

The polyol ester preferably has a pour point of about −100° C. or lower to −40° C. and a viscosity of about 2–460 centistoke at 100° C.

Preferably from about 10 to about 95, more preferably to about 25 to about 90, and most preferably to about 60 to about 85% by volume of the synthetics, which may be either polyalphaolefins, polyesters or mixtures thereof, will be employed in the formulations of the present invention in a typical crank case. Formulations with about four times those percentages will be used in a typical bottled concentrate for adding to the conventional oil in a crankcase.

Dispersant Inhibitor (DI)

Though not narrowly critical, the DI is exemplified by those which contain alkyl zinc dithiophosphates, succinimide, or Mannich dispersants; calcium, magnesium, sulfonates, sodium sulfonates, phenolic and amine antioxidants, plus various friction modifiers such as sulfurized fatty acids.

Dispersant inhibitors are readily available from Lubrizol, Ethyl, Oronite, a division of Chevron Chemical, and Paramains, a division of Exxon Chemical Company.

Generally acceptable are those commercial detergent inhibitor packages used in formulated engine oils meeting the API SHCD performance specifications. Particularly preferred are Lubrizol 8955, Ethyl Hitec 1111 and 1131, and similar formulations available from Paramains, a division of Exxon Chemical, or Oronite, a division of Chevron Chemical.

Concentration of DIs will probably be in the range of about 0.5–35, more preferably 1.0–25, and most preferably 5–20% by volume of the total formulation based on the final crankcase formulation for an internal combustion engine. Concentrations in concentrates produced for dilution will generally be about four times these ranges.

PTFE (polytetrafluoroethylene)

The PTFE for use with the present invention is preferably a dispersion of fine particles in colloidal form. A preferred average particle size would be in the range of from about 0.05–3.0 micrometers (microns) and can be in any convenient nonaqueous media; e.g., synthetic or mineral base oil, compatible with the remainder of the formulation. Commercial PTFE dispersions which are suitable for the invention include Achinson SLA 1612 manufactured by Acheson Colloids Company, Michigan. U.S. Pat. No. 4,333,840 to Reick discloses a lubricant composition of PTFE in a motor oil carrier diluted with a major amount of a synthetic lubricant having a low viscosity and a high viscosity index.

The preferred dosage of PTFE in the total crankcase lubricant is from about 0.01 to about 10, more preferably from about 0.05 to about 5, and most preferably from about 0.1–3 weight % PTFE.

Viscosity Index Improver (VI)

Viscosity improvers include, but are not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers and Shellvis 90, a styrene-butadiene rubber in mineral oil base;

Preferably the VI will constitute 0.05–5, more preferably 0.07–3, and most preferably 0.1–2 wt. % of the crankcase motor oil.

Mineral Oil Base Stock

Particularly preferred as mineral oil base stocks are the Valvoline 325 Neutral and 100 Neutral, manufactured by the Valvoline Division of Ashland Oil, Inc, and by others.

Other acceptable petroleum-base fluid compositions include white mineral, paraffinic and MVI naphthenic oils having the viscosity range of about 20–400 Centistoke. Preferred white mineral oils include those available from Witco Corporation, Arco Chemical Company, PSI and Penreco. Preferred paraffinic oils include solvent neutral oils available from Exxon Chemical Company, HVI neutral oils available from Shell Chemical Company, and solvent treated neutral oils available from Arco Chemical Company. Preferred MVI naphthenic oils include solvent extracted coastal pale oils available from Exxon Chemical Company, MVI extracted/acid treated oils available from Shell Chemical Company, and naphthenic oils sold under the names Hydro-Cal and Calsol by Calumet, and described in U.S. Pat. No. 5,348,068 to Oldiges.

Mineral oil base stock will comprise preferably 5–95, more preferably 65–90 and most preferably 75–80 by volume in the motor oil, but is not narrowly critical.

II. Utility of the Invention

The invention will find use in a wide variety of lubricants, including motor oils, greases, sucker-rod lubricants, cutting fluids, and even spray-type lubricants. The invention has the multiple advantages of saving energy, reducing engine or other hardware maintenance and wear, and therefore, provides an economical solution to many lubricating problems commonly encountered in industry or consumer markets.

DESCRIPTION OF THE PREFERRED EMBODIMENTS

EXAMPLE 1

(The Invention Using Mo, Synthetic, PTFE, DI and VI Additive)

An additive package designed for addition to conventional motor oil in the crankcase of an internal combustion engine is prepared in a 2000 gallon jacketed, stirred vessel heated to approximately 40° C. First there is added 600 gallons of polyalphaolefins (PAO 4 cSt) obtained from Ethyl Corporation under the trademark Durasyn 164; 43 gallons of PAO 6 centistoke Durasyn 166 obtained from the same source, and 93 gallons of diester obtained under the brand name Emery 2960. Stirring continues during the addition of all the ingredients. The above mixture is termed "synthetic" and is a synthetic base stock. To the synthetic is added 123 gallons of dispersant inhibitor (DI) package obtained under the brand name Lubrizol 8955, Lubrizol Corporation; 5 gallons of an 8% concentrate of Shell Vis 1990 viscosity index improver, 25 gallons of Molyvan 855 obtained from R. T. Vanderbilt and Company, and 52 gallons of SLA 1612 obtained from Acheson Colloids, a 20% concentration of colloidal DuPont Teflon® brand PTFE. The resulting mixture is stirred for an additional 30 minutes, sampled and tested for viscosity, metal concentration, and other quality control checks.

The resulting concentrate is bottled into one quart containers and a single container is added to the four quarts of conventional motor oil in a five quart crank case of an automobile.

Figure 1:
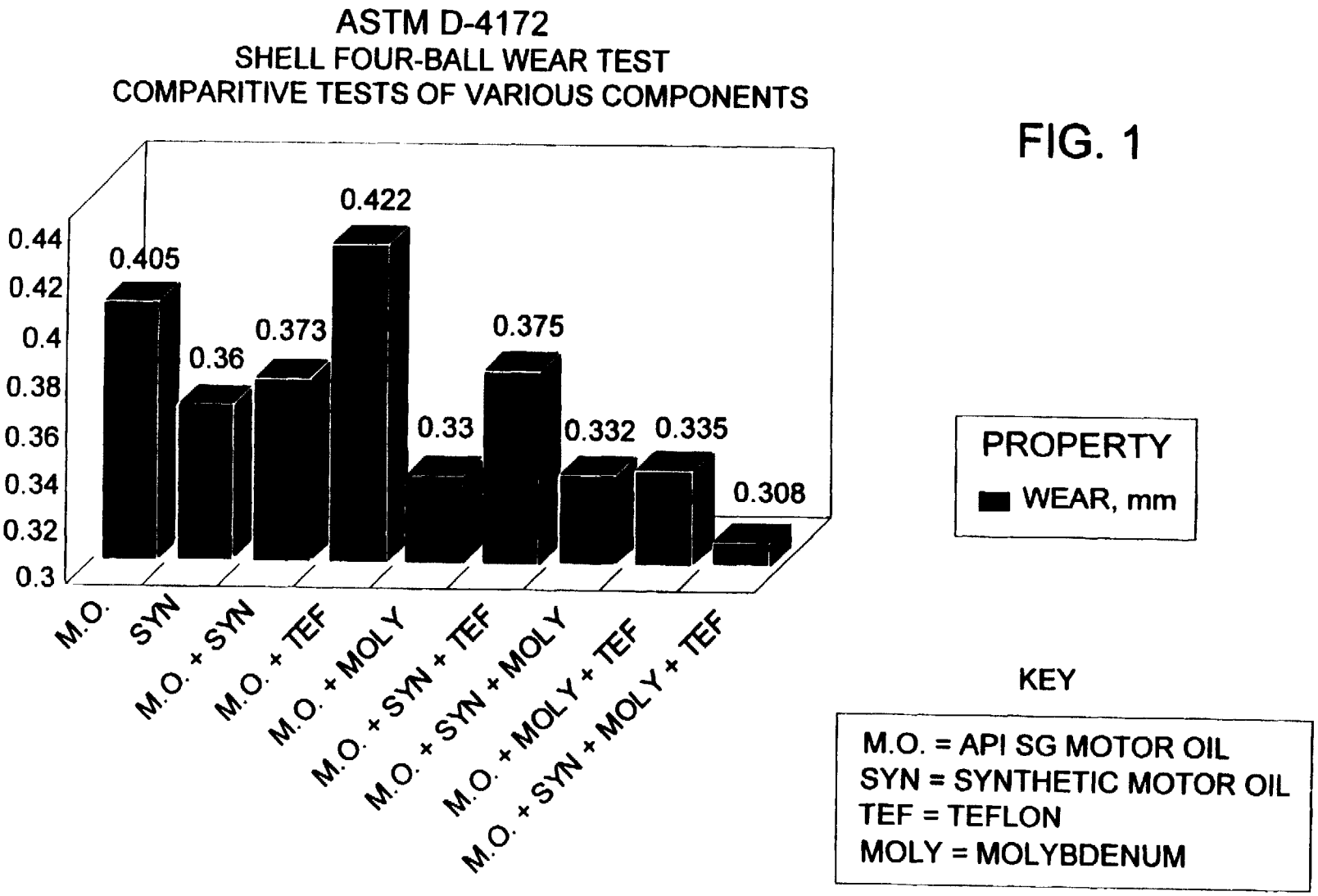
FIG. 1 is a bar chart of ASTM D4172 four-ball wear results versus lube compositions.
Figure 2:
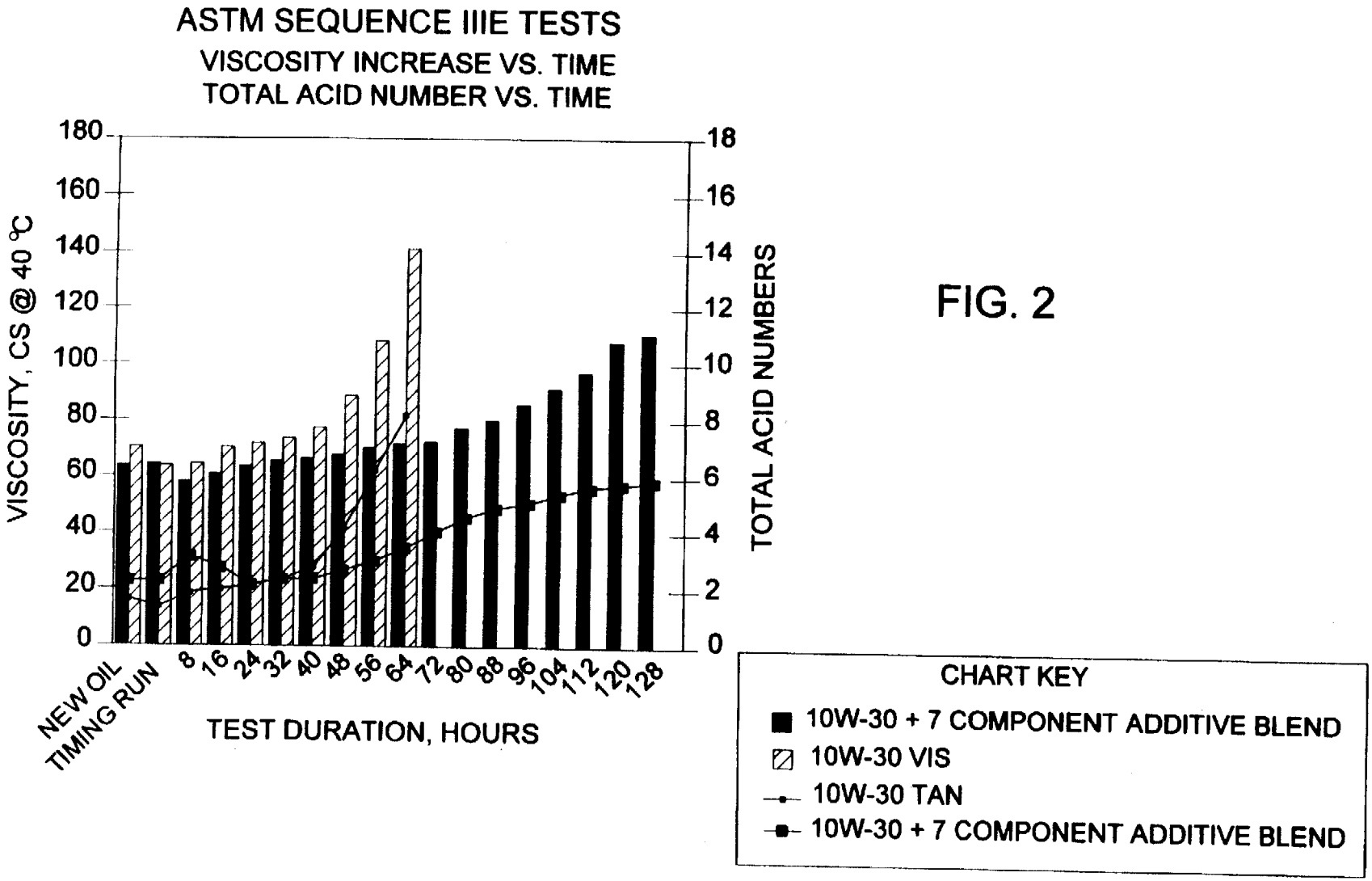
FIG. 2 is a multiple parameter graph of base oil compared to additized oil showing viscosity increase and acid number increase versus time in ASTM Sequence IIIE tests.
Figure 3:
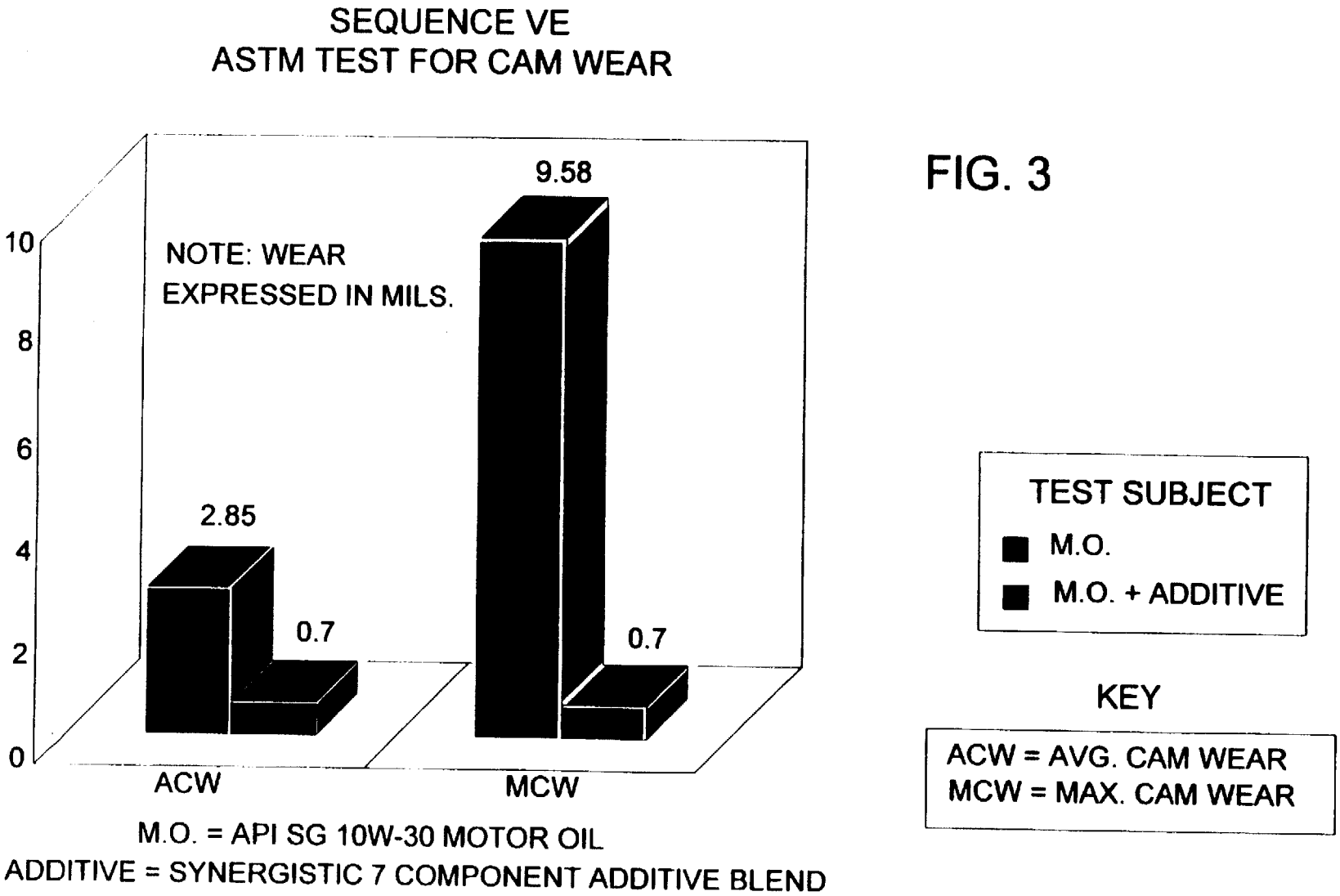
FIG. 3 graphs ASTM Sequence VE test results of average (and maximum) cam wear for the invention versus conventional motor oil.
Figure 4:
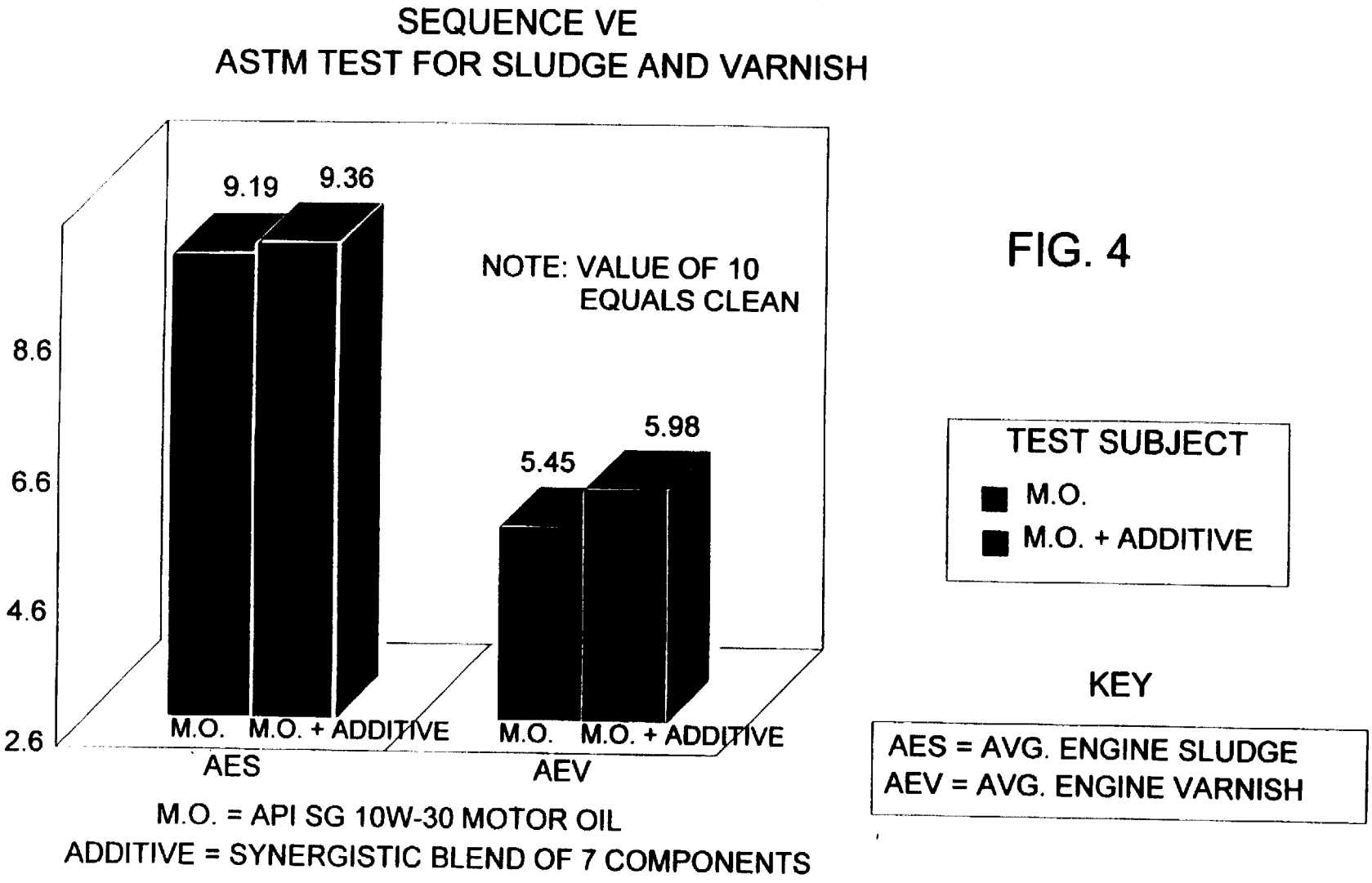
FIG. 4 graphs the substantial improvement in engine cleanliness in the Sequence VE test.
Figure 5:
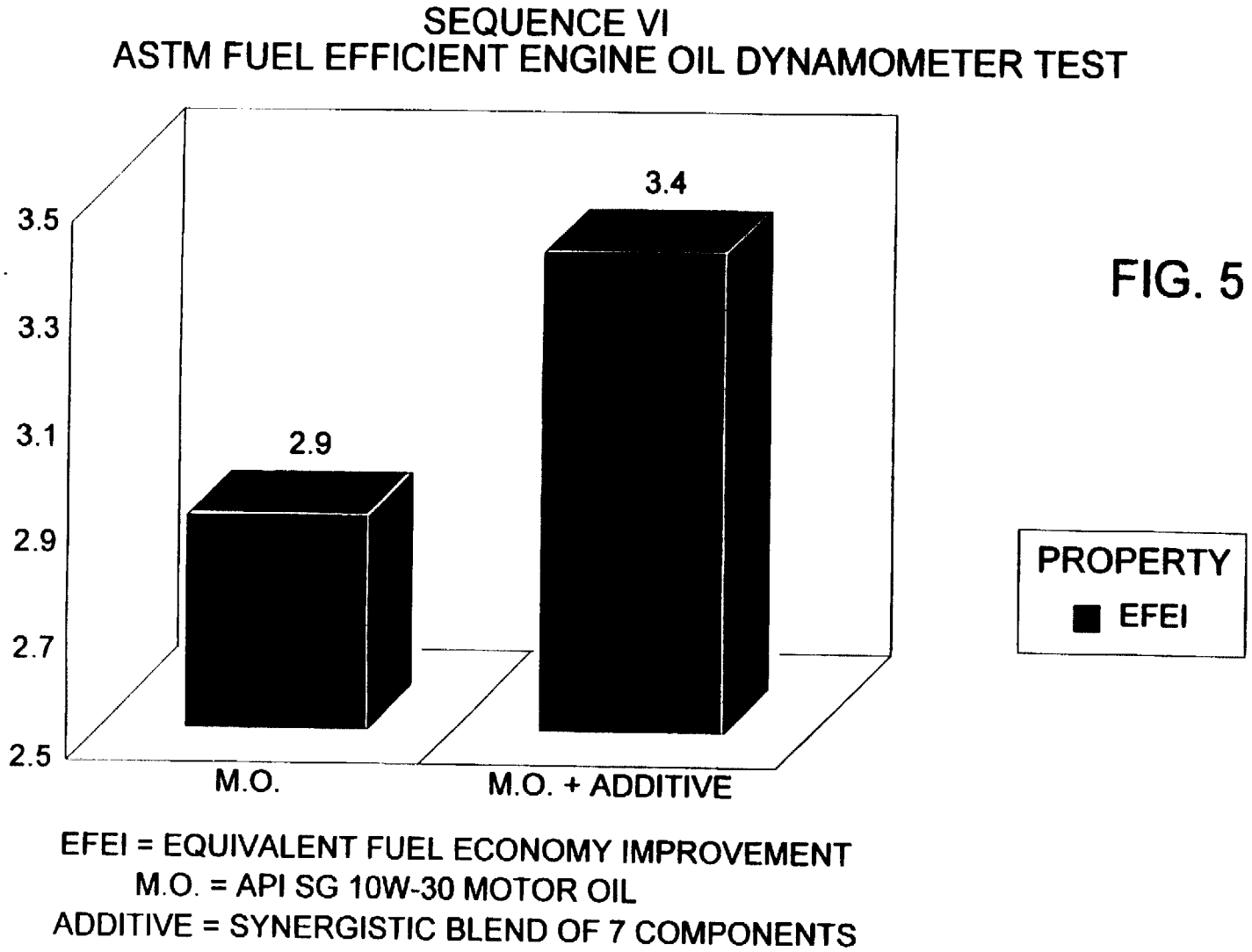
FIG. 5 graphs ASTM Sequence VI fuel economy and shows 17% improvement from the invention.

The result is improved wear (FIGS. 1 and 3), oxidation resistance (FIG. 2), viscosity stability (FIG. 2), engine cleanliness (FIG. 4), fuel economy (FIG. 5), cold starting (Table 2, and inhibited acid formation (FIG. 2).

EXAMPLE 2

(The Invention Under Standard Tests)

When one of the one quart formulations prepared in Example 1 is tested under conventional lubricant test procedures, results are as given in Tables 1 and 2, and FIGS. 1–5. Note that the Shell four-ball wear test ASTM D 4172 of FIG. 1 and Table 1 is the bench test most indicative of engine performance of a lubricant.

When the same ingredients of Example 1 are formulated while omitting one or more of the ingredients, the comparative results are as shown in Table 1 and FIG. 1.

As can be seen from Tables 1 and 2, and FIGS. 1 through 5, the results using this additive show a remarkable improvement when compared to a conventional motor oil tested without the additive of the invention.

EXAMPLE 3

The additive produced in Example 1 is added to cutting oils used in industrial milling machines, tapping machines, extruders, lathes, broaching, and gear hobbing, and the results indicate improved lubricity and longer life for both the cool and the lubricating fluid.

EXAMPLE 4

The grease composition according to the invention is conventionally mixed with a litium soap of a fatty acid to thicken the composition, an improved grease showing the advantages of the invention results.

TABLE 1

ASTM 4172 Shell Four Ball

| TEST | AC | SYN | AC + SYN | AC + TEF | AC + MOLY | AC + SYN + TEF | AC + SYN + MOLY | AC + MOLY + TEF | AC +SYN + MOLY + VI + DI* |
|---|---|---|---|---|---|---|---|---|---|
| Shell Four-Ball Wear, mm | 0.405 | 0.360 | 0.373 | 0.422 | 0.330 | 0.375 | 0.332 | 0.335 | 0.308 |

MO Motor Oils, Valvoline 10W30 All-Climate
SYN Valvoline 5W30 Synthetic, includes DI and VI
AC + SYN 10W30 AC + (20%) 5W30 Synthetic
MOLY Molybdenum
TEF Teflon ®
*Invention of Example 1

TABLE 2

ASTM 4742 - 88 Oxidation

| Sample | RFOUT (min)** | TFOUT (min)* | Ruler*** | CCS @ 20° C. cP | TP1 @ 20° F. cP |
|---|---|---|---|---|---|
| A | 180 | 138 | 211 | 3,030 | 12,540 |
| C | 370 | 279 | 322 | 2,160 | 9,360 |

Note: A 10W30 All Climate (Control)
C 80% 10W30; 20% (synthetic oil, 1.0% Teflon ®, 0.5% moly)
*Thin Film Oxygen Uptake
**Modified test of ASTM 4742
***Remaining Usefull Life Evaluation Routine

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

For example, blends of specific ingredients may be particularly valuable.

Reference to documents made in the specification is intended to result in such patents or literature being expressly incorporated herein by reference including any patents or other literature references cited within such documents.

TABLE A

ADDITIVE COMPOSITIONS

| Parameter | Units | Preferred | More Preferred | Most Preferred | Target Formulation Vol. % |
|---|---|---|---|---|---|
| Synthetic Base Stock | Vol. % | 10–95 | 25–90 | 60–85 | 74 |
| Viscosity Improver (100%) | Wt. % | 0.05–5 | 0.07–3 | 0.1–2 | 6.5 |
| Molybdenum (Mo) | Wt. % | 0.05–5 | 0.07–3 | 0.1–2 | 2.5 |
| PTFE | Wt.% | 0.01–10 | 0.05–5 | 0.1–3 | 20 |
| Dispersant (12.3% vol.) | Vol. % | 0.5–35 | 1–25 | 5–20 | 123 |
| Dilution Before Use: | Vol. Lubr. Vol. Addit. | 0–25 | 0.5–15 | 1–10 | 4–5 |

What is claimed is:

1. An improved lubricating composition providing improved wear, fuel economy and viscosity stability for rotating machinery comprising in combination:

a. about 0.05–5 wt. % of oil soluble molybdenum additive;

b. about 0.01–10 wt. % of a nonaqueous polytetrafluoroethylene, together with conventional and/or synthetic motor oil or grease.

2. A composition according to claim 1 additionally comprising about 10–90 vol. % of synthetic base stock comprising diesters and/or polyalphaolefins.

3. A composition according to claim 1 additionally comprising about 0.5–5 wt. % of viscosity index improver.

4. A composition according to claim 1 wherein the synthetic base stock comprises at least 10% polyalphaolefins.

5. A composition according to claim 1 wherein said nonaqueous polytetrafluoroethylene comprises a colloidal-dispersed nonaqueous polytetrafluoroethylene.

6. A composition according to claim 1 additionally comprising a dispersant inhibitor.

7. A composition according to claim 6 wherein said dispersant inhibitor comprises ZDP.

8. A composition according to claim 3 wherein said viscosity index improver comprises polyisobutenes, polymethacrylate acid esters, polyacrylate acid esters, diene polymers, polyalkyl styrenes, alkenyl aryl conjugated diene copolymers and/or polyolefins.

9. A concentrate for dilution with conventional and/or synthetic motor oil comprising in combination:

a. about 0.35–15 wt. % of an oil soluble molybdenum additive;

b. about 0.25–25 wt. % of a nonaqueous polytetrafluoroethylene, together with conventional and/or synthetic motor oil or grease;

c. about 0–90 vol % of synthetic base stock comprising diesters and/or polyalphaolefins;

d. about 0.35–25 wt. % of viscosity index improver;

said concentrate, when diluted with about 0.5–15 parts (volume) of said motor oil in a crankcase of an internal combustion engine, providing that engine with improved wear reduction, fuel economy and viscosity stability.

10. A process of manufacturing an improved lubricating composition additive comprising mixing together at about 0°–100° C.:

a. about 0.35–15 wt. % of oil soluble molybdenum additive;

b. about 0. 25–25 wt. % of nonaqueous polytetrafluoroethylene, together with conventional and/or synthetic motor oil or grease;

c. about 0–90 vol. wt. % of synthetic base stock comprising diesters and/or polyolefins; and d. about 0–15 wt. % of viscosity index improver;

said concentrate, when diluted with about 0.5–15 parts of said motor oil in a crankcase of an internal combustion engine, providing that engine with improved wear reduction, fuel economy and viscosity stability.

11. The lubricating composition for rotating machinery as recited in claim 1, wherein said oil soluble molybdenum additive is an organo molybdenum compound.

12. The lubricating composition for rotating machinery as recited in claim 11, wherein said organo molybdenum compound is selected from the group consisting of sulfonated oxymolybdenum dialkyldithiophosphate, and sulfide molybdenum di-thiophosphate.

13. The lubricating composition for rotating machinery as recited in claim 1, wherein said oil soluble molybdenum additive is selected from the group consisting of Molyvan 855, Molyvan L, Molyvan A, Molyvan 871, Molyvan 855, Molyvan 856, Molyvan 822, and Molyvan 807, and Sakura Lube-500.

14. The lubricating composition for rotating machinery as recited in claim 1, wherein said oil soluble molybdenum additive is an inorganic molybdenum compound.

15. The lubricating composition for rotating machinery as recited in claim 1, wherein said inorganic molybdenum compound is selected from the group consisting of molybdenum sulfide and molybdenum oxide.

16. The lubricating composition for rotating machinery as recited in claim 2, wherein said diester is a di-aliphatic diesters of alkyl carboxylic acid.

17. The lubricating composition for rotating machinery as recited in claim 16, wherein said di-aliphatic diesters of alkyl carboxylic acid is selected from the group consisting of di-2-ethylhexylazelate, di-isodecyladipate, and di-tridecyladipate.

18. The lubricating composition for rotating machinery as recited in claim 2, wherein said synthetic base stock is a mixture of at least one diester with at least one polyalphaolefin.

19. The lubricating composition for rotating machinery as recited in claim 2, wherein said diester is a polyol ester.

20. The lubricating composition for rotating machinery as recited in claim 19, wherein said diester is selected from the group consisting of Emery 2935, Emery 2936, Emery 2939 Hatco 2352, Hatco 2962, Hatco 2925, Hatco 2938, Hatco 2939, Hatco 2970, Hatco 3178, and Hatco.

21. The lubricating composition for rotating machinery as recited in claim 19, wherein said polyol ester has a pour point of less than about −100° C. to about −40° C. and a viscosity of from about 2 to about 460 centistoke at 100° C.

22. The lubricating composition for rotating machinery as recited in claim 2, wherein said polyalphaolefin is selected from the group consisting of Ethyl-flow 162, Ethyl-flow 164, Ethyl-flow 166, Ethyl-flow 168, ethyl-flow 174, Mobil P-43, Mobil SHF-42, Emery 3004, Emery 3006, Synton PAO-40, and Hatco 2939.

23. The lubricating composition for rotating machinery as recited in claim 2, wherein said polyalphaolefin is has a viscosity of from about 2 to about 460 centistoke.

24. The lubricating composition for rotating machinery as recited in claim 2, wherein said polyalphaolefin is has a viscosity of from about 2 to about 10 centistoke at 200° C.

25. The lubricating composition for rotating machinery as recited in claim 2, wherein said polyalphaolefin is has a viscosity of from about 4 to about 6 centistoke at 200° C.

26. The lubricating composition for rotating machinery as recited in claim 2, wherein said synthetic base stock comprises from about 25 to about 90 percent by volume.

27. The lubricating composition for rotating machinery as recited in claim 2, wherein said synthetic base stock comprises from about 60 to about 85 percent by volume.

28. The lubricating composition for rotating machinery as recited in claim 3, wherein said viscosity index improve comprises from about 0.05 to about 5.0 weight percent of the crankcase motor oil.

29. The lubricating composition for rotating machinery as recited in claim 3, wherein said viscosity index improve comprises from about 0.07 to about 3.0 weight percent of the crankcase motor oil.

30. The lubricating composition for rotating machinery as recited in claim 3, wherein said viscosity index improve consititutes from about 0.1 to about 2.0 weight percent of the crankcase motor oil.

31. The lubricating composition for rotating machinery as recited in claim 5, wherein said nonaqueous polytetrafluoroethylene comprises from about 0.01 to about 10.0 weight percent in the total crankcase lubricant.

32. The lubricating composition for rotating machinery as recited in claim 5, wherein said nonaqueous polytetrafluoroethylene comprises from about 0.05 to about 5.0 weight percent in the total crankcase lubricant.

33. The lubricating composition for rotating machinery as recited in claim 5, wherein said nonaqueous polytetrafluoroethylene comprises from about 0.1 to about 3.0 weight percent in the total crankcase lubricant.

34. The lubricating composition for rotating machinery as recited in claim 6, wherein said dispersant inhibitor is selected from the group consisting of alkyl zinc dithiophosphates, succinimide, Mannich dispersants, or combinations thereof.

35. The lubricating composition for rotating machinery as recited in claim 6, wherein said dispersant inhibitor are selected from the group consisting of Lubrizol 8955, Ethyl Hitec 1111, and Hitec 1131.

36. The lubricating composition for rotating machinery as recited in claim 6, wherein said dispersant inhibitor comprises from about 0.5 to about 35.0 by volume of the total crankcase formulation.

37. The lubricating composition for rotating machinery as recited in claim 6, wherein said dispersant inhibitor comprises from about 1.0 to about 25.0 by volume of the total crankcase formulation.

38. The lubricating composition for rotating machinery as recited in claim 6, wherein said dispersant inhibitor comprises from about 5.0 to about 20.0 by volume of the total crankcase formulation.

39. The concentrate for dilution with conventional and/or synthetic motor oil as recited in claim 9, wherein said oil soluble molybdenum additive is an organo molybdenum compound.

40. The concentrate for dilution with conventional and/or synthetic motor oil as recited in claim 9, wherein said organo molybdenum compound is selected from the group consisting of sulfonated oxymolybdenum dialkyldithiophosphate, and sulfide molybdenum di-thiophosphate.

41. The concentrate for dilution with conventional and/or synthetic motor oil as recited in claim 9, wherein said oil soluble molybdenum additive is selected from the group consisting of Molyvan 855, Molyvan L, Molyvan A, Molyvan 871, Molyvan 855, Molyvan 856, Molyvan 822, and Molyvan 807, and Sakura Lube-500.

42. The concentrate for dilution with conventional and/or synthetic motor oil as recited in claim 9, wherein said oil soluble molybdenum additive is an inorganic molybdenum compound.

43. The concentrate for dilution with conventional and/or synthetic motor oil as recited in claim 42, wherein said inorganic molybdenum compound is selected from the group consisting of molybdenum sulfide and molybdenum oxide.

44. The concentrate for dilution with conventional and/or synthetic motor oil as recited in claim 9, wherein said diester is a di-aliphatic diesters of alkyl carboxylic acid.

45. The concentrate for dilution with conventional and/or synthetic motor oil as recited in claim 44, wherein said di-aliphatic diesters of alkyl carboxylic acid is selected from the group consisting of di-2-ethylhexylazelate, di-isodecyladipate, and di-tridecyladipate.

46. The concentrate for dilution with conventional and/or synthetic motor oil as recited in claim 9, wherein said synthetic base stock is a mixture of at least one diester with at least one polyalphaolefin.

47. The concentrate for dilution with conventional and/or synthetic motor oil as recited in claim 9, wherein said diester is a polyol ester.

48. The concentrate for dilution with conventional and/or synthetic motor oil as recited in claim 9, wherein said diester is selected from the group consisting of Emery 2935, Emery 2936, Emery 2939 Hatco 2352, Hatco 2962, Hatco 2925, Hatco 2938, Hatco 2939, Hatco 2970, Hatco 3178, and Hatco.

49. The concentrate for dilution with conventional and/or synthetic motor oil as recited in claim 47, wherein said polyol ester has a pour point of less than about −100° C. to about −40° C. and a viscosity of from about 2 to about 460 centistoke at 100° C.

50. The concentrate for dilution with conventional and/or synthetic motor oil as recited in claim 9, wherein said polyalphaolefin is selected from the group consisting of Ethyl-flow 162, Ethyl-flow 164, Ethyl-flow 166, Ethyl-flow 168, ethyl-flow 174, Mobil P-43, Mobil SHF-42, Emery 3004, Emery 3006, Synton PAO-40, and Hatco 2939.

51. The concentrate for dilution with conventional and/or synthetic motor oil as recited in claim 9, wherein said polyalphaolefin is has a viscosity of from about 2 to about 460 centistoke.

52. The concentrate for dilution with conventional and/or synthetic motor oil as recited in claim 9, wherein said polyalphaolefin is has a viscosity of from about 2 to about 10 centistoke at 200° C.

53. The concentrate for dilution with conventional and/or synthetic motor oil as recited in claim 9, wherein said polyalphaolefin is has a viscosity of from about 4 to about 6 centistoke at 200° C.

54. The concentrate for dilution with conventional and/or synthetic motor oil as recited in claim 9, wherein said synthetic base stock comprises from about 25 to about 90 percent by volume.

55. The concentrate for dilution with conventional and/or synthetic motor oil as recited in claim 9, wherein said synthetic base stock comprises from about 60 to about 85 percent by volume.

56. The concentrate for dilution with conventional and/or synthetic motor oil as recited in claim 9, wherein said viscosity index improve consititutes from about 0.05 to about 5.0 weight percent of the crankcase motor oil.

57. The concentrate for dilution with conventional and/or synthetic motor oil as recited in claim 9, wherein said viscosity index improve consititutes from about 0.07 to about 3.0 weight percent of the crankcase motor oil.

58. The concentrate for dilution with conventional and/or synthetic motor oil as recited in claim 9, wherein said viscosity index improve consititutes from about 0.1 to about 2.0 weight percent of the crankcase motor oil.

59. The concentrate for dilution with conventional and/or synthetic motor oil as recited in claim 9, wherein said nonaqueous polytetrafluoroethylene comprises from about 0.01 to about 10.0 weight percent in the total crankcase lubricant.

60. The concentrate for dilution with conventional and/or synthetic motor oil as recited in claim 9, wherein said nonaqueous polytetrafluoroethylene comprises from about 0.05 to about 5.0 weight percent in the total crankcase lubricant.

61. The concentrate for dilution with conventional and/or synthetic motor oil as recited in claim 9, wherein said nonaqueous polytetrafluoroethylene comprises from about 0.1 to about 3.0 weight percent in the total crankcase lubricant.

62. The concentrate for dilution with conventional and/or synthetic motor oil as recited in claim 9, including a dispersant inhibitor.

63. The concentrate for dilution with conventional and/or synthetic motor oil as recited in claim 62, wherein said dispersant inhibitor is selected from the group consisting of alkyl zinc dithiophosphates, succinimide, Mannich dispersants, or combinations thereof.

64. The concentrate for dilution with conventional and/or synthetic motor oil as recited in claim 62, wherein said dispersant inhibitor is selected from the group consisting of Lubrizol 8955, Ethyl Hitec 1111, and Hitec 1131.

65. The concentrate for dilution with conventional and/or synthetic motor oil as recited in claim 62, wherein said dispersant inhibitor comprises from about 0.5 to about 35.0 by volume of the total crankcase formulation.

66. The concentrate for dilution with conventional and/or synthetic motor oil as recited in claim 62, wherein said dispersant inhibitor comprises from about 1.0 to about 25.0 by volume of the total crankcase formulation.

67. The concentrate for dilution with conventional and/or synthetic motor oil as recited in claim 62, wherein said dispersant inhibitor comprises from about 5.0 to about 20.0 by volume of the total crankcase formulation.

68. The process of manufacturing an improved lubricating composition of claim 10, including the step of mixing together at about 0°–100° C. from about 0.5–35 vol. % of a dispersant inhibitor.

69. A lubricating composition comprising a major amount of an oil of lubricating viscosity and a minor amount of the composition of claim 1.

70. A lubricating composition comprising a major amount of an oil of lubricating viscosity and a minor amount of the composition of claim 9.

71. A motor oil composition comprising a major amount of an oil of lubricating viscosity and a minor amount of the composition of claim 9.

72. A motor oil composition comprising a major amount of an oil of lubricating viscosity and a minor amount of the composition of claim 65.

* * * * *